US005970548A

United States Patent [19]

Welch

[11] Patent Number: 5,970,548

[45] Date of Patent: Oct. 26, 1999

[54] PLEATED SAC FOR PATIENT SUPPORT MATTRESS

[76] Inventor: Robert Dudley Welch, 39 North Road, London N7 9DP, United Kingdom

[21] Appl. No.: 08/894,185

[22] PCT Filed: Feb. 14, 1996

[86] PCT No.: PCT/GB96/00347

§ 371 Date: Nov. 7, 1997

§ 102(e) Date: Nov. 7, 1997

[87] PCT Pub. No.: WO96/25073

PCT Pub. Date: Aug. 22, 1996

[30] Foreign Application Priority Data

Feb. 14, 1995 [GB] United Kingdom ..... 9502887
Oct. 31, 1995 [GB] United Kingdom ..... 9522207

[51] Int. Cl.[6] ..... A61G 7/057

[52] U.S. Cl. ..... 5/710; 5/712; 5/713

[58] Field of Search ..... 5/644, 706, 710, 5/711, 712, 713, 714, 715, 654, 655.3

[56] References Cited

U.S. PATENT DOCUMENTS 3,780,388 12/1973 Thomas et al. ..... 5/711
5,704,084 1/1998 Evans et al. ..... 5/713

FOREIGN PATENT DOCUMENTS 2083865 12/1971 France .
2177594 1/1987 United Kingdom ..... 5/710
2 267 217 12/1993 United Kingdom .
WO 89/08439 9/1989 WIPO .
WO 95/15706 6/1995 WIPO .

*Primary Examiner*—Michael Trettel
*Attorney, Agent, or Firm*—Woodcock Washburn Kurtz Mackiewicz & Norris LLP

[57] ABSTRACT

A support sac for a patient support mattress comprises an elongate sac formed of a pressure retaining flexible material adapted to be fluid filled under pressure. The sac has a body contact portion (10) remote from a support surface portion (22), the body contact portion being provided with a plurality of pleats or ruffles whereby said contact portion has a surface area per unit length significantly greater than the surface area per unit length of the support surface portion thereby to alleviate hammocking effects.

14 Claims, 4 Drawing Sheets

FIG.1
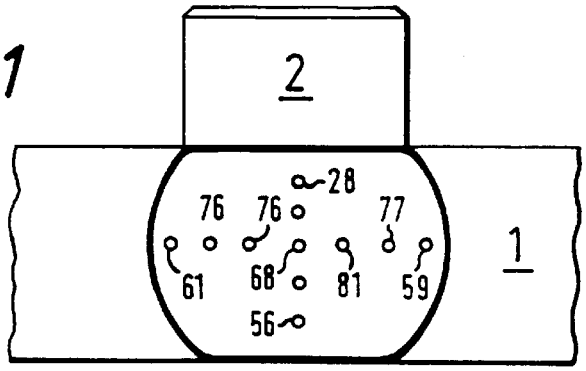
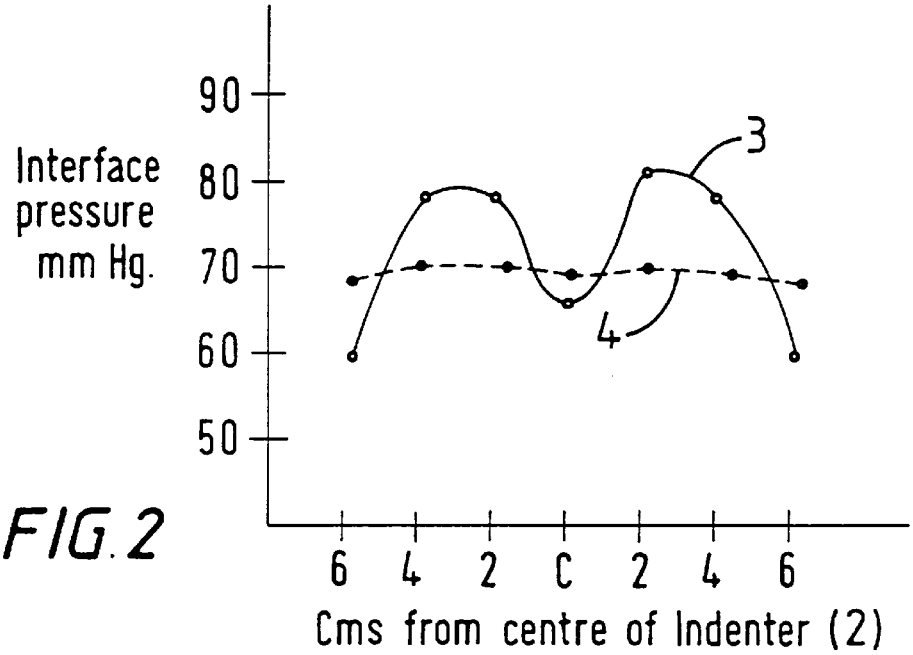
FIG.2
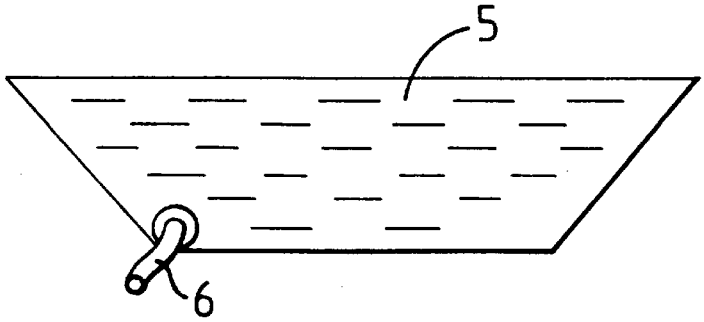
FIG.3A

FIG. 3B
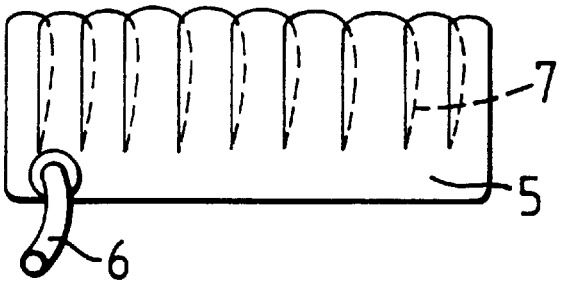
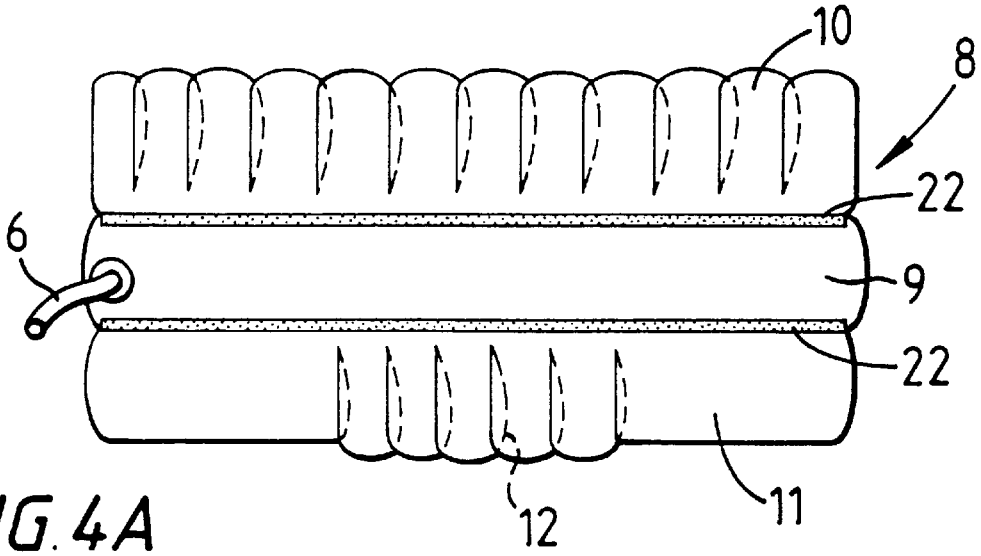
FIG. 4A
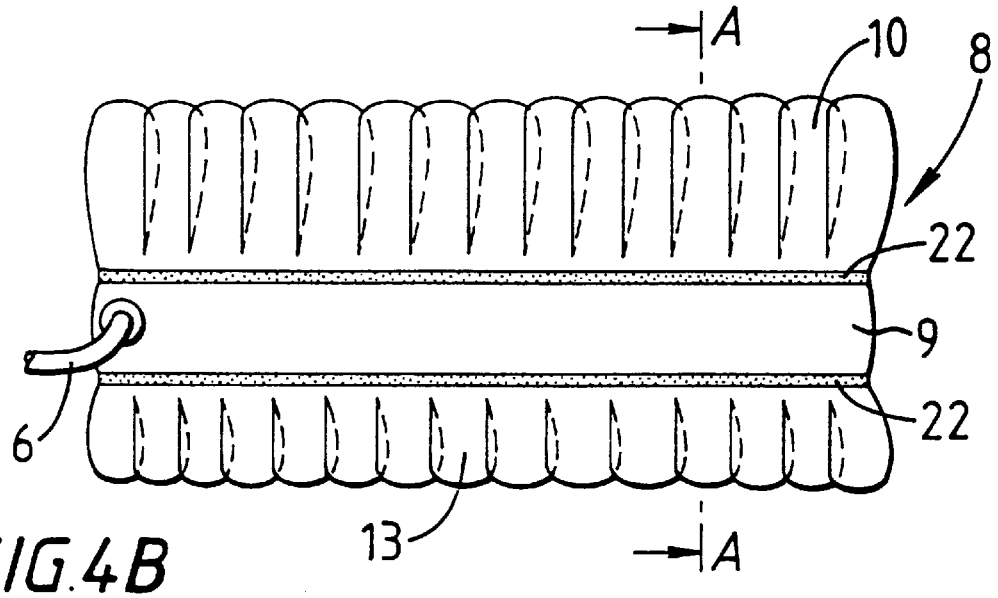
FIG. 4B

FIG. 10
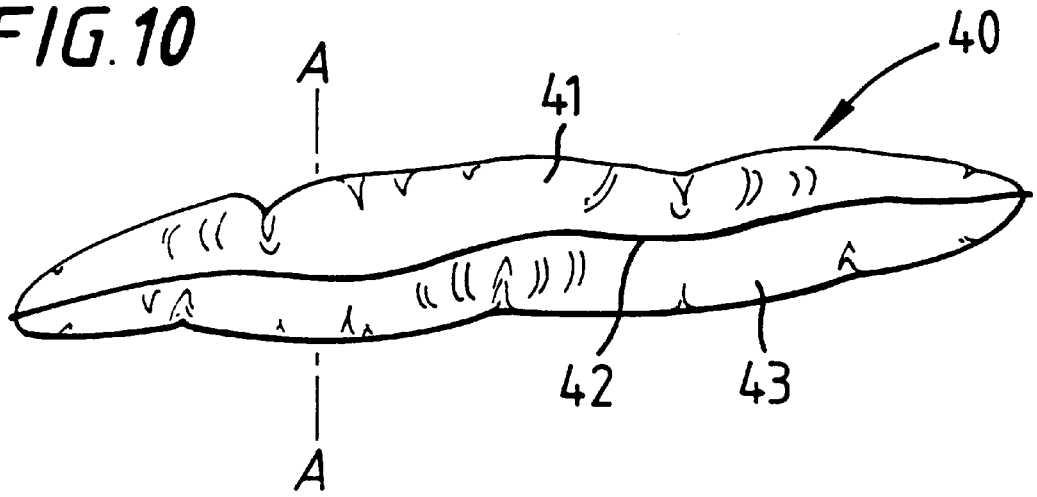
FIG. 10A
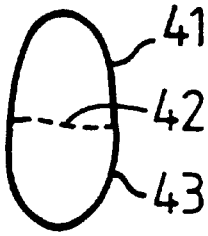
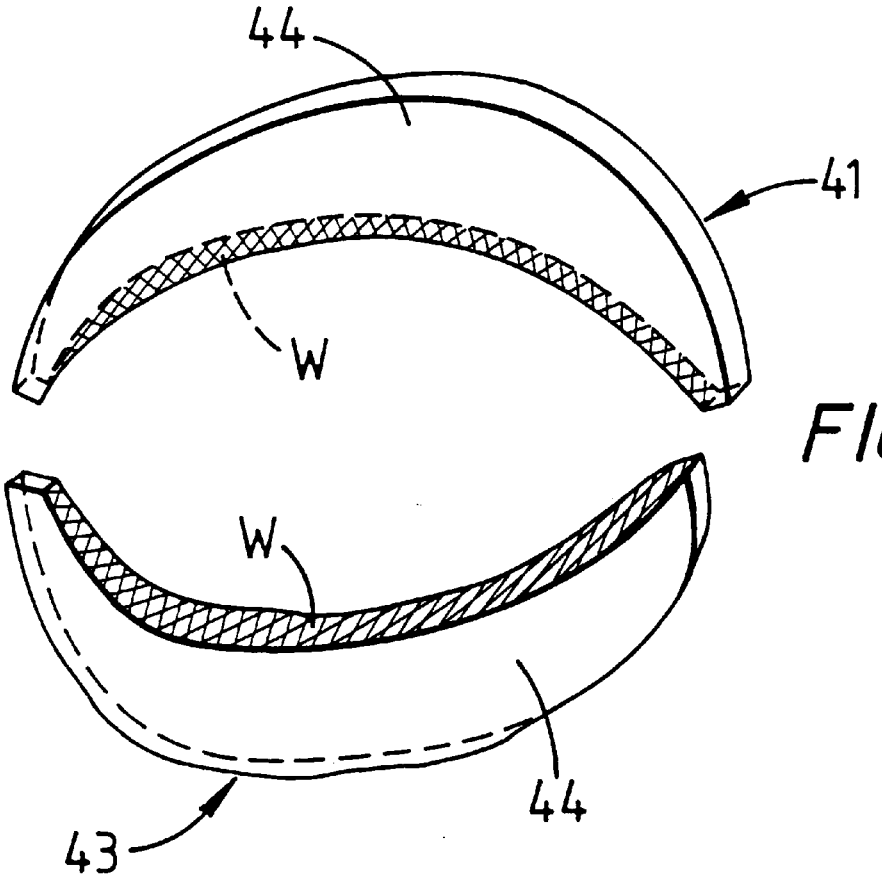
FIG. 11

PLEATED SAC FOR PATIENT SUPPORT MATTRESS

The present invention relates to sacs for patient support mattresses of the static pressure, alternating pressure and low air loss type.

Alternating pressure type air beds are to be found described in GB-A-1595417. Briefly this document describes an air bed for patient support, for example in a burns unit or in geriatric care, which comprises a plurality of overlying flexible pressure resistant tubes which are inflated and deflated in an alternating cycle over about 5 to 10 minutes. The purpose of this is to reduce the period of time that an immobile body tissue carries weight which could shut off or reduce blood flow. Thus every five minutes or so every skin tissue is unstressed by weight and hence where blood flow is weak the capillary system can operate to oxygenate the unstressed tissue.

The effect of this is for example to greatly assist the prevention and healing of bed (pressure) sores. There are a number of different developments of this type in use, all of which have as a goal the reduction of point loading of particular parts of the body on an alternating basis. As will be apparent bony prominences such as the sacrum are particularly prone to cause problems with tissue perfusion in semi-immobile geriatric patients, or those who have undergone significant surgery. One example of an air bed of this type is in the marketplace under the trade mark "Pegasus".

Another approach to this problem has been the use of the low air loss bed concept, for example, that marketed under the trade mark "Mediscus". In this arrangement, the patient is in effect supported on air contained in a plurality of water proof, but water-vapour permeable, air sacs. Air is caused to flow through the air sacs at about 140 $m^3$/hr. The plurality of sacs are arranged in, for example, four groups of five sacs, and each is adjusted to a pressure suitable for support of a part of the patient's body. Again the air sacs used are essentially flexible although they are made of a material which allows for a degree of resilience.

In another type of fluid filled mattress, a static pressure air filled mattress is provided. The mattress is valved so that the pressure can be adjusted to a desired value when the patient is in situ on the mattress.

All these mattress types suffer to a greater or lesser extent from the problem of "hammocking". Hammocking is the effect which takes place when the weight of a human body is transferred to pressure bearing flexible contact faces such as tubes. The effect of point loading on such tubes is to cause local stretching (to an extent) such that a portion at least of the loading is accepted, not by the pressurised air, but by the stretching of the material of the tube. This causes localised pressures to rise and induces shear forces between the skin and the material, and hence increases the loading of certain areas of the skin adjacent for example a bony prominence. These arrangements therefore can be improved such that the weight transfer is nearer to the ideal, in that the whole weight of the patient's body is borne by a fluid (i.e. the pressure exerted over a section of a patient's body is more equalised whatever the body shape).

The Applicant has now discovered that the above ideal can be more nearly approached by arranging that the body contact surface is provided with a pleated or ruffled contact surface, particularly one in which the longitudinal length of the sac is maintained by a longitudinally extending substantially non-extensible member. This allows body prominences to sink into the surface material with much reduced hammocking thereby more readily transferring the patient's weight to the fluid and so tending to equalize pressure relative to adjacent skin portions.

Accordingly support sacs for use in the foregoing mattress types can be improved in performance by the arrangement of the present invention. The invention also provides that the fluid may be any suitable gas, vapour, liquid or gel or a mixture thereof, so long as it fulfils the requirements of the alleviation of hammocking.

According therefore to the present invention there is provided an elongate support sac for a patient support mattress which comprises a sac formed of a pressure retaining flexible material adapted to be fluid filled under pressure, characterized in the sac comprises a body contact surface portion remote from a support surface portion, and in that the body contact surface portion is provided with a plurality of ruffles or pleats. Said body contact portion may have a surface area per unit length significantly greater than the surface area per unit length of the support surface portion thereby alleviating hammocking.

Preferably the sac contains at least one longitudinally extending substantially non-extensible member thereby to reduce or restrain the sac from longitudinal extension to ensure that the pleats and/or ruffles remain in place under load. The non-extensible member may be a string or cord but is more preferably continuous or partially discontinuous tubular member to which the pleats may be secured. It is more preferable that the non-extensible member when used should be positioned as far as possible from the contact surface to avoid uncomfortable contact with the patient.

In one embodiment the ruffles or pleats may extend normal to the axis of the sac. These may be in the form of one or more interconnected arcuate members so that the cross-section of the sac is provided with at least "ear" portions.

These "ear" portions may be ruffled or pleated in the horizontal direction or not depending upon the eventual use of the sac. Where the sac is provided with one or more "ear" portions, these may be unitary, i.e. conjoined to each other and not to the central longitudinally extending portions of the sac or may be formed of at least two optionally pleated tubes having their axis parallel to that of the sac and operatively interconnected therewith.

In a preferred form of the invention, the sac may be filled with a gas, liquid, gel or low friction powder and is connected to a source of pressurization. Preferably the sac is adapted to be filled by pressurized air and optionally includes means for alteration of the internal pressure of the sac on a cyclical basis.

The pleating is conveniently disposed perpendicular to the length of the air sac, but of course, may also be longitudinal of its axial length, or angled to the axis of the sac. The term pleated as used herein includes the term ruffled.

In low air loss beds, the air sacs of the adjacent group are not subject to alternating pressure. In such cases, air sacs of the present invention may be used. Particularly suited to such an embodiment are effectively single celled elongate air sacs provided with upper contact and lower support, surfaces, especially those in which the upper contact surface is in cross-section bifurcated or trifurcated.

While the support surface is generally planar, the upper contact surface is pleated. An approximation of the ratio of the lower to the upper surfaces is 1:1.67 to 1:2.0 in terms of material length before any pleating.

In alternating pressure air beds, because they tend to operate at higher pressure, each air sac of the mattress may be more complex because otherwise the air sac tends to adapt a "banana" shape. Accordingly, between the upper contact, and the lower support surface is interposed an intermediate portion which is at least substantially unpleated and acts as the longitudinal non-extensible member. By means of careful design, the tendency of the upper contact surface to deform can be counteracted by an approximately equal and opposite tendency of the lower support surface. This deformation tendency can be adjusted with an average patient weight in mind to give a better result.

Accordingly, a preferred feature of the invention provides an air sac formed of a flexible material for operative connection to a source of pressurised gas; characterised in that the air sac comprises an upper ruffled or pleated body contact portion and a lower pleated support portion, and in that an intermediate portion is interposed between said upper and lower portions, said intermediate portion being at least substantially unpleated such that its axial longitudinal extension is limited. The pleats preferably extend onto the base portion.

In another feature of the invention, where the non-extensible member is positioned remote from the contact surface, a plurality of transverse supports may be provided between the non-extensible member and the contact surface to restrain the size of the sac from excess arcuate deformation; while also reducing the possibility that the patient can feel the transfer supports in use via the contact surface. In a preferred embodiment of this type, the pleat/ruffle ratio of the upper contact portions is between 1:1.57 to 1:2.5 with the higher values being indicative of the ratio of the skin contact surface.

The support portion may be similarly pleated along its length, but in a preferred embodiment is pleated only over a central section of about ½ to ⅓ the axial length. The pleat/ruffle ratio of the low support portion is 1:2.0 to 1:3.0, preferably about 1:2.5 with the higher values being associated with the support surface such as a bed base or a flat or shallow V-shaped mattress.

The air sac of the present invention may be used substantially as a stack which extends along the axis of, but perpendicular to, a mattress or bed base. Each air sac may be connected to a source of pressurised gas (e.g. air) so that the pressure in the air sacs can be adjusted either to a constant or alternating value as required by the intended final use. Each sac is preferably provided with areas for retaining the same in position, for example, a reinforced ring through which a securing cord may pass.

The air sacs may be fabricated from any flexible and/or resilient material, for example, polyurethane or PVC or a fabric supported polyurethane. The pleats may be stuck and/or sewn or vacuum formed and then welded as appropriate. The material may be arranged to seep air.

In an alternative method of manufacture, the pleats or ruffles may be formed by causing relative expansion of the body contact portion or relative reduction in axial length of the intermediate portion when the intermediate portion is used.

In the case of a single sac, the sac may be formed as a preform and inserted into a heated mould. The preformed sac is filled with air or an inert gas and heat is then applied differentially such that the body contact portion is heated to a significantly higher value than the support portion. With the positive air pressure within the formed sac but with the support portion retained by the mould, and since the temperature of the body contact portion is locally raised above the thermoplastic threshold of the material used, the body contact portion will deform non-elastically to form pleats and/or ruffles.

Alternatively and/or additionally vacuum forming may be used to achieve this end.

Accordingly therefore to a further aspect of the present invention there is provided a method for the production of a support sac for a patient support mattress which comprises:

providing an arcuate moulding member defining an inwardly directed channel, said channel being provided with means for inducing a negative pressure therewithin;

securing a heat and/or pressure deformable sheet of plastics material over the free ends of said channel, and applying heat and negative pressure to said mould thereby to vacuum form an arcuate member of a generally u-shaped configuration in said plastics material, and subsequently after, or during, cooling straightening the arcuate member thereby to induce pleats and/or ruffles in said intended contact surface. The free edges of the arcuate member may then be secured to a longitudinally non-extensible intermediate member by welding, sticking, sewing etc.

In another method for the manufacture of the pleated/ruffled sac, particularly where an intermediate, non-axially stretchable portion is used, the intermediate portion may be formed of a material which after fabrication without pleats, for example by moulding and/or welding of different but compatible plastics materials, is axially shrinkable, for example by the application of heat. In all these arrangements when using a part-welded material, the application of heat will also result in an improved bonding for the welds.

Where more than one sac portion is used in a stacked orientation, it is desirable that the diameter of the uppermost, (i.e. the body contact portion) shall be greater than that of the sac portions beneath. Thus, where there are three sac portions the body contact portion should preferably have a diameter greater than that of the intermediate portion which in turn may have a diameter greater than the support portion. This is to ensure that since the internal pressure of the sac is a single value, the sac collapses under point load in a structured way so that the patient does not tend to feel the harder portions of the sac under high point-loads.

The invention will now be described by way of illustration only with reference to the accompanying drawings wherein:

FIG. 1 shows a diagrammatic view of a test air tube of the prior art with indentor applied, from below;

FIG. 2 shows a graph of interface pressure against indentor pressure at given distances from the centre thereof in mm/Hg. The full line shows the prior art values while the broken line shows the invention at the same pressure;

FIG. 3A shows a low air loss sac as a polymethane blank with air input/output attached, while FIG. 3B shows the sac of FIG. 3A in its final pleated form;

FIG. 4A shows a side view of an alternating pressure air sac of a first form with a high pleat ratio but reduced length support area; whilst FIG. 4B shows a side view of an alternative form of air sac;

FIGS. 10, 10A and 11 show views of an elongate tube incorporating a sac arrangement of the present invention.

Figure 5:
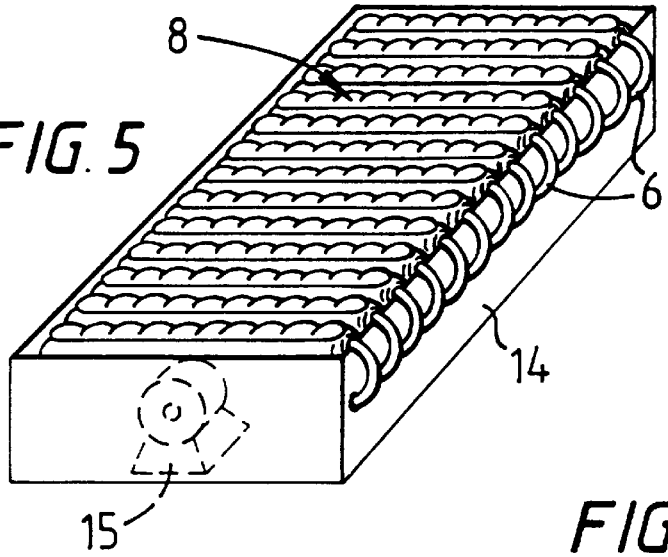
FIG. 5 shows from above an air bed in a diagrammatic form retained in a bed base.

Referring to FIGS. 1 and 2, these show the effects which occur when an inflated cell deforms under load of an indentor. The indentor is a rounded object adapted to mimic the effect of a bony prominence. The deformation is referred to as "hammocking" which results in the measured interface pressures being higher than the nominal air pressure in the cell because of the additional forces from tensioned skin.

The relationship between the measured interface pressure Pi and the air pressure within the cell Pa may be expressed as:

$$Pi = Pa\left(1 \times \frac{r}{R}\right) \text{ where}$$

r is the radius of the cell, R is the radius of the indentor.

This may be seen in FIG. 1 wherein the indentor having a radius of 9.5 cm is applied to a polyurethane tubular cell of radius 3.5 cm. This gives a hammocking ratio of about 1.37. The hammocking ratio is expected to remain at that factor up to any usable pressure in the cell. It will be appreciated that where the contact portion of the body, e.g. the heels are of small radius, the value of R should be reduced as well to achieve best results.

With the Indentor centrally located on the tubular inflated cell, it would be expected that the maximum interface pressure would be found centrally. This was not the case however, in that in practice it was found that there was a significant drop in interface pressure at the domed central contract point, with an increased pressure reading disposed there about. Typical figures are shown in FIG. 1 and separately in the full line of FIG. 2. This effect is due in part to material displacement under pressure, and is due in part to stretching of the material under load. Where the object imparting the load is the skin, this extra pressure is applied thereto obturating the capillary network and starving the skin of oxygenated blood.

With reference to FIG. 1, it will be seen that the tubular air sac (1) is inflated to about 60 mm/Hg and then the indentor (2) is applied thereto. Where the force on the central point of the indentor is ±68 mm/Hg, the other relative figures hold good in approximate proportion. This gives rise to the full line graph (3) in FIG. 2.

The broken line graph (4) in FIG. 2 shows the predicted results obtained from a pleated cell of the invention under the same conditions. It will be noted that the graph is significantly flatter.

The air sacs of the invention are of two types in the present examples. The low air loss type of FIGS. 3A and 3B and the alternating air pressure types of FIGS. 4A and 4B.

With reference to FIG. 3A, two trapezoidal blanks (5) of a fabric reinforced polyurethane material were superimposed and welded along their joint edges; an air-inlet/outlet (6) was also formed therein in an air tight fashion.

The longer edge of the trapezoidal section was either then, or previously had been, formed with pleats (7) shape as shown in FIG. 3B. This may be done by adhesively securing and/or stitching, and then welding or a combination of all or some of these. As a result, the body contact portion at the top of the section has a surface area per unit length greater than the surface area per unit length of the effective support surface portion at the bottom of the section.

The air sac so formed may be positioned on an air bed as shown in FIG. 5 to be described later.

Alternatively the arrangement of FIG. 4A may be used in an alternating air pressure bed (8). In this arrangement, an elongate tube (9) is formed in operative interconnection with an upper pleated contact portion (10) and a lower pleated support portion (11).

The upper pleated contact portion (10) has a pleat ratio of about 1.67 relative to the unpleated elongate tube (9), the area at the interface of the upper pleated contact portion (10) and the elongate tube (9) serving as the effective support surface portion. The lower surface support (11) is pleated but only centrally at (12), and preferably at a higher ratio than the upper pleated portion (10). Alternatively as shown in FIG. 4B the lower support portion (13) has a pleated configuration over its full length. The purpose of the lower support surface pleats (12) and (13) is to balance the "banana" effect of the upper pleated parts.

The full depths of the air sacs of FIGS. 3A to 4B is of the order of 200 to 300 mm.

Figure 6:
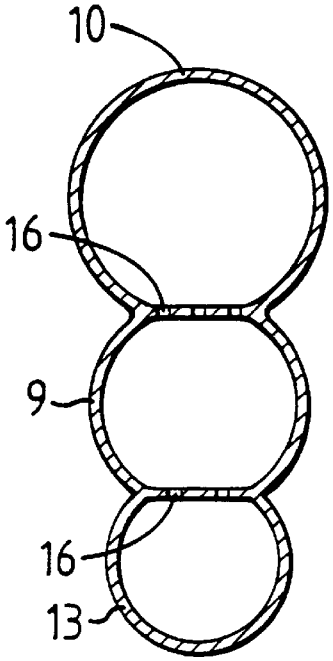
FIG. 6 shows an arrangement of FIG. 4 in vertical cross-section along a line AA of FIG. 4B.

FIG. 6 shows a vertical section through an arrangement of FIG. 4B. In this arrangement the body contact portion (10) has a diameter larger than that of the intermediate elongate tube (9) which again has a diameter larger than the lower support portion (13). In this instance, body contact portion has a circumference (transverse) of about 34 cm, the elongate tube (9) has a circumference of about 28 cm and the lower support portion (13) has a circumference of about 20 cm. A plurality of apertures (16) interconnect the tube (9) with the lower support portion (13) and with the body container portion (10) thereby to equilibrate internal pressure.

As shown in FIG. 5, a bed base (14) retains a plurality of sacs (8). In the arrangement shown, the plurality of sacs (8) are each supplied with air pressure via an input/output port (6), each independently connected to an air pressure controller/timer (not shown) and via that to a pump as shown in ghost lines at (15).

With the air sacs inflated to 60 'mm/Hg and by use of the indentor of FIG. 1, a pressure profile of the broken lines of FIG. 2 may be achieved.

Figure 7:
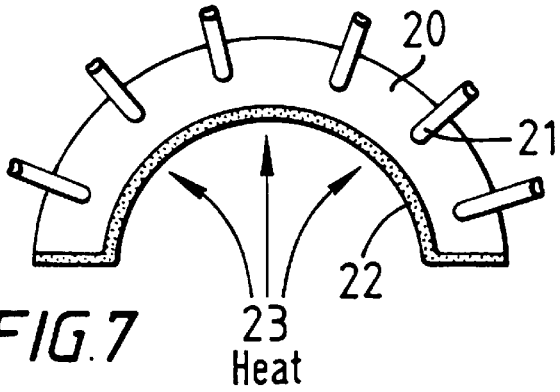
FIG. 7 shows in diagrammatic side elevation a mould with a plastics material applied thereto.
Figure 8:
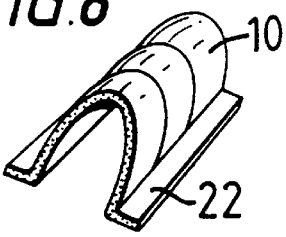
FIG. 8 shows a body contact portion obtained from the mould of FIG. 7 prior to welding to an intermediate portion.

With reference to FIGS. 7 and 8, FIG. 7 shows an arcuate mould (20) having a generally u-shaped transverse cross-section with the free ends of the U-shaped facing inwardly. The mould (20) has a plurality of the vacuum points (21) disposed at regular intervals about the mould and communicating with the interior of the channel. By means of these, vacuum may be applied to the interior of the channel member in appropriate circumstances.

A rectangular sheet of a plastics material (22) is disposed over and secured to the inner edges of the mould so as to form an air-tight seal. Heat (23) shown diagrammatically may then be applied to the material (22) while vacuum is applied via the vacuum portion (21). When the plastics material has been fully formed, heat and pressure is withdrawn and the formed material is allowed to cool. When cooled, or as it cools, the formed plastics material is removed from mould (20) and straightened so as to adopt a shape shown in FIG. 8 with flanges (22) for welding, completed portions (10) as shown in FIG. 4A and 4B. The flange portion (22) may be welded to the longitudinally non-extensible intermediate member (9) by traditional means.

As shown in FIG. 6 a series of apertures (16) are disposed between the intermediate portion (9) and the pleated portions (10) and (14) so as to allow pressure equilibration. These ports (16) may be replaced by a plurality of discrete strips to form a ladder like configuration in an alternative.

Figure 9A:
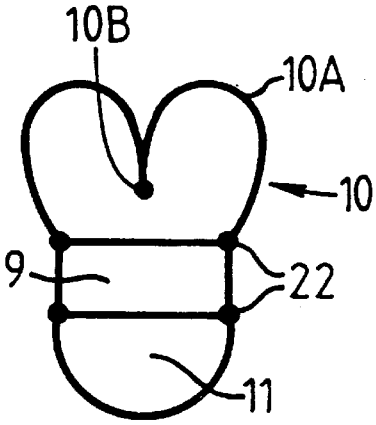
FIGS. 9A to 9C show a transverse cross-section through various sacs in accordance with FIG. 3B and FIG. 4A.
Figure 9B:
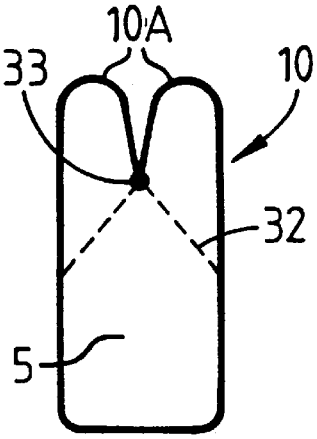
Figure 9C:
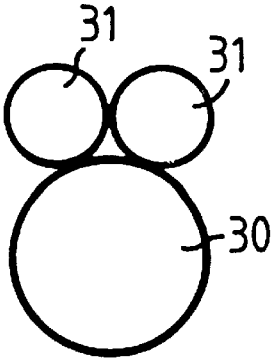

FIG. 9 shows at FIG. 9B a transverse cross-section through a sac of FIG. 3B and in FIGS. 9A and 9C, a transverse cross-section through a sac of FIG. 4.

With reference particularly to FIG. 9B, there is shown a support section (5) integrally formed with upwardly extending double pleat members (10A) to form a single plate (10). The point of conjunction (33) of the double-pleat members (10A) is provided with ties (32) to secure the same against vertical expansion. This arrangement is particularly suitable for low-loss air beds particularly where the completed portion (10) is pleated in the longitudinal direction as shown in FIG. 3B.

FIG. 9A shows a transverse cross-section to the arrangement of FIG. 4A.

In accordance with the arrangement previously described, an elongate tube (9) is formed in operative connection with an upper (4) pleated contact portion (10) and a lower pleated support portion (11). These are welded together by longitudinal welds (22) in an air-tight fashion. The upper pleated portion (10) in provided with a bifurcated portion (10A) which is pleated in the longitudinal direction as shown in FIG. 4A, and in the transverse direction as shown in FIG. 9A. The bifurcated pleated portion (10A) are conjoined at (10B), which conjuncture (10A) may be linked to the material of the sac by means of cords to prevent upward unfurling of the bifurcated portion. The effect of this is to increase the surface area available for prevention of hammocking.

FIG. 9C relates to a basic type of air sac. A longitudinally extending support tube (30) is provided at its upper contact surface with a pair of longitudinally extending tubes (31), the contact surfaces of which may be pleated or unpleated. It will be appreciated that the internal pressure of the contact tube (30) is the same as that of each tube (31). It will also be appreciated that in the unpleated condition, the contact tube (31) provide a more hammocking resistant surface than would a single tube, and similarly that in a pleated condition the arrangement provides a simpler but effective unit for resisting hammocking particularly when used in conjunction with a foam layer.

FIGS. 10, 10A and 11 show a further sac arrangement of the invention. As shown, an elongate tube (40) includes an upper support portion (41) and a lower support portion (43), separated by a transverse internal support member (42). The support member (42) is provided with apertures to allow fluid to flow freely between portions (41) and (43).

The tube (40) is formed by welding together two "banana" shaped structures corresponding to the upper and lower support portions (41) and (43) as illustrated in FIG. 11.

The portions (41) and (43) are welded together at cross-hatched areas "W" of each banana shape. In practice, only a single transverse support member (42) is provided at the area of contact, the member (42) serving as the effective support surface portion. The excess material in the side faces (44) of the banana-shaped structures corresponding to portions (41) and (42) forms pleats in the tube (40) when the tube is straightened as shown in FIG. 10. Such pleats act to prevent hammocking.

EXAMPLE 1

In order to compare the pressure signatures achievable by standard commercial air beds, an air bed substantially as shown in FIG. 5 and incorporating air bags as shown in FIG. 4A (the invention) was tested against a standard foam NHS mattress, a "Pegasus" Air Mattress and the "Nimbus 2" Air Mattress.

This was effected by positioning a pressure pad at the sacrum, the ischial protuberance, the heel and the trochanter of a series of healthy volunteers and measuring maximum and minimum pressure values in each case and averaging the same. The minus percentage values arc therefore particularly desirable since they indicate the percentage improvement over standard values.

In this example, the "Oxford Pressure Monitor Mark II" was used for all readings. This determines the interface pressure for observation of the pressure flow characteristics of small pulses of air.

The positioning of the sensors were as follows:

Semi-recumbent—right heel, left heel, sacrum, left ischial tuberosity, right ischial tuberosity.

Side Lying—left trochanter.

The heels and the ischial/sacral region are chosen for investigation as they represent a comparatively light yet bony area in the case of the heel whereas the sacrum/ischial tuberosities when semi-recumbent have an area which has considerable loading over a much larger surface. Therefore in making measurements at these sites, the performance of the mattress to a variety of loading patents can be assessed. The trochanter is chosen and is often considered one of the most difficult areas in which to achieve satisfactory pressure relief.

The subject used in this evaluation were all members of Salisbury Hospital Retirement Fellowship and hence have an average age of over 70 years. All are ambulant and in good health. None have any current sores or a history of pressure sores. During the tests they all wear standard night wear or loose fitting underclothes. A single sheet is placed over each mattress. It is not tucked in but left to lie loose, all wrinkles being smoothed out.

For the measurements on the sacrum, ischials and heels, the back rest is left at 45° and the mattress is placed over the top of the back rest. Two pillows are used to support the head. For the measurement on the trochanter, the beds are flat with the subjects' heads being supported on two pillows. Both hip and knee angles are at 60° by using specially constructed foam templates.

The 3*4 sensor arrays are taped to the skin over the sacrum and over both ischials with the subject standing with the hips flexed at 45° in a similar position to that which they will adopt on the bed during the tests. Care is taken to ensure that there is no tape across the surface of any of the pressure elements. The subject is then carefully transferred onto the bed and the bed is checked to ensure none of the sensors are creased or folded.

If any problem is found, the sensor is then inspected and any creases removed and the pressure is remeasured. The subject then remains stationary on the bed for two complete cycles so the bed can adjust to the weight of the subject. The readings are than taken in two complete cycles for the sacrum and one complete cycle for the ischial tuberosities. The maximum, minimum and average pressures measured over one or two cycles is then printed out using a programming facility. Foot blocks are adjusted to ensure that the patient does not slide down the bed during tests.

Pressures are measured on the heels using individual cells connected to a standardized computer. One sensor is taped to each heel over the point of maximum pressure and the heel is positioned on the ridge of the mattress with the foot hold vertically. The block or board used to prevent the subject from slipping down the bed in the sacral readings is not used as false readings can occur due to some pressure being taken on the soles of the feet.

However, the block or board is used as an indicator to observe if the subject slips down the bed. Readings on both heels simultaneously on two complete cycles. Again the maximum, minimum and average pressures are recorded. The head is supported on two pillows and the subject is left in the position of two complete cycles during which time measurements are taken to ensure the sensor is lying correctly before the actual readings are taken again over two cycles. Maximum, minimum and average pressure readings are then recorded.

The ten volunteers who participated in the study had an average age of 67 years and an average weight of 60.9 kg and an average height of 1.64 m. For each given subject, the maximum pressure measured on each location on each mattress was noted. This maximum pressure and the corresponding minimum and average pressures for the same sensor were then used to calculate a mean average pressures and examined deviations for all subjects on that mattress. The results obtained in that way were shown in Table I.

TABLE I

| CONTRACT AREA | STANDARD NHS AVERAGE MATTRESS | MAXIMUM PRESSURE | MINIMUM PRESSURE | PRESSURE |
|---|---|---|---|---|
| SACRUW | 74 | 39 | 61 | 27 |
| Mean | 17 | 18 | 16 | 13 |
| St. Dev. | | −48% | −18% | −64% |
| Conf. Int. | | | | |
| % Pressure | | | | |
| ISCHIALS | 54 | 41 | 61 | 25 |
| Mean | 16 | 13 | 14 | 11 |
| St. Dev. | | −24% | +13% | −54% |
| Conf. Int. | | | | |
| % Pressure | | | | |
| TROCH. | 99 | 43 | 65 | 20 |
| Mean | 24 | 10 | 18 | 8 |
| St. Dev. | | −57% | −34% | −80% |
| Conf. Int. | | | | |
| % Pressure | | | | |
| HEELS, | 112 | 74 | 115 | 24 |
| FULL CELL | 23 | 14 | 21 | 9 |
| Mean | | −34% | +3% | −79% |
| St. Dev | | | | |
| Conf. Int. | | | | |
| % Pressure | | | | |
| HEELS, | 113 | 29 | 58 | 10 |
| HALF CELL | 15 | 29 | 37 | 21 |
| Mean | | −74% | −49% | −91% |
| St. Dev. | | | | |
| Conf. Int. | | | | |
| % Pressure | | | | |
| AVERAGE PERCENT PRESSURE FULL CELL | | −41% | −9% | |
| AVERAGE PERCENT HALF CELL | | −22% | −72% | |

The results presented above have been obtained using the protocol described above and developed from the Department of Health Mattress evaluation project.

As such, these readings are directly comparable with those published in the Department of Health Publication PS4 to be published shortly. It can be seen that the results of the product are impressive especially after the large cells on the heals were replaced with cells of half of the width. The initial reading on the first two volunteers showed that some design modifications were needed to improve the performance of the mattress in the sacral/pelvic area when the subject was in a semi-recumbent position. Hence the readings presented here on the sacrum and ischials are only on eight subjects not on ten.

There are six sets of readings on the large heel cells and four sets of readings on the half sized heel cells which are shown to make a substantial improvement. As both heels are measured the statistical analysis was undertaken with twelve and eight readings of full and half heels respectively.

The readings on this product compare very well with market leaders which are measured as part of the Department of Health Trial. These were shown in Table II below.

TABLE II

| | PEGASUS Product A | NIMBUS Product B |
|---|---|---|
| Sacrum | | |
| Ave | 51 mm/Hg | 41 mm/Hg |
| Max | 88 mm/Hg | 85 mm/Hg |
| Min | 23 mm/Hg | 28 mm/Hg |
| Ischials | | |
| Ave | 42 mm/Hg | 34 mm/Hg |
| Max | 67 mm/Hg | 52 mm/Hg |
| Min | 25 mm/Hg | 26 mm/Hg |
| Trochanter | | |
| Ave | 49 mm/Hg | 49 mm/Hg |
| Max | 92 mm/Hg | 78 mm/Hg |
| Min | 22 mm/Hg | 34 mm/Hg |
| Heels | | |
| Ave | 68 mm/Hg | 77 mm/Hg |
| Max | 174 mm/Hg | 139 mm/Hg |
| Min | 12 mm/Hg | 118 mm/Hg |

The average pressure reduction figures over all sites on the two market leaders were then compared with the inventive system below:

TABLE III

| | 1st Tech (large heel cells) | 1st Tech (small heel cells) | Pegasus A | Nimbus B |
|---|---|---|---|---|
| Ave | −41% | −51% | −30% | −35% |
| Max | −9% | −22% | +30% | +10% |
| Min | −69% | −72% | −69% | −62% |

Negative pressures correspond to a reduction in pressure and positive values and relate to an increase in pressure compared to the standard hospital mattress values of which are given in Table I.

As can be seen, the air mattress in accordance with the present invention provides improved comparative pressure signatures throughout the range of pressures points. This is particularly so with reference to the heal area shown as "D" in FIG. 2 which shows a higher average value for the heel area.

It will be understood that the embodiments illustrated show applications of the invention in certain forms only for the purposes of illustration. In practice, the invention may be applied to many different configurations, the detailed embodiments being straight forward for those skilled in the art to implement.

For example, foregoing arrangements have been described with reference to inflatable air tubes or sacs, but it will be appreciated that static fluid filled sacs equally benefit from the alleviation of the sores as described.

The invention provides therefore a novel patient support mattress.

I claim:

1. A support sac for a patient support mattress which comprises an elongate sac formed of a pressure retaining flexible material adapted to be fluid filled under pressure, characterized in that the sac comprises a body contact portion remote from a support surface portion, and in that the body contact portion is provided with a plurality of pleats, or ruffles whereby said body contact portion has a surface area per unit length significantly greater than a surface area per unit length of the support surface portion, thereby to alleviate hammocking effects.

2. The sac according to claim 1 wherein the sac is filled with a fluid selected from a gas, a liquid, a gel or a low friction powder.

3. The sac according to claim 1 wherein the sac is adapted for connection to a source of fluid pressure.

4. The sac according to claim 3 wherein the sac is air filled and connected to a pump for alteration of the internal pressure thereof.

5. The sac according to claim 1 wherein the pleats extend generally perpendicular to the axis of the sac.

6. The sac according to claim 5 wherein the sac is effectively single celled, and wherein the body contact portion is generally pleated, and the support surface is generally unpleated.

7. The sac according to claim 6 wherein a pleat/ruffle ratio of the body contact portion is 1:1.67 to 1:2.0.

8. The sac according to claim 5 wherein the sac comprises an intermediate portion interposed between said body contact portion and said support surface portion, said intermediate portion being substantially unpleated and limiting longitudinal extension of the sac, said support surface portion disposed lower than the body contact portion and having a plurality of pleats.

9. The sac according to claim 8 wherein the support surface portion is pleated over a central portion thereof, the pleat/ruffle ratio of said central portion is higher than the pleat/ruffle ratio of the body contact portion.

10. The sac according to claim 9 wherein the support surface portion is pleated only over the central portion.

11. The sac according to claim 8 wherein the diameter of the pleated body contact portion is larger than the diameter of the support portion.

12. The sac according to claim 11 wherein the support surface portion and the intermediate portion have the same diameter.

13. The sac according to claim 11 wherein the support surface portion has a diameter that is less than a diameter of the intermediate portion.

14. A mattress comprising a plurality of adjacent sacs for a patient support mattress, each one of the sacs comprising an elongate sac formed of a pressure retaining flexible material adapted to be fluid filled under pressure, each one of the plurality of sacs comprising a body contact portion remote from a support surface portion, the body contact portion having a plurality of pleats, said body contact portion having a surface area per unit length significantly greater than a surface area per unit length of the support surface portion whereby hammocking effects are alleviated.

* * * * *